US006681475B2

(12) United States Patent
Thibault et al.

(10) Patent No.: US 6,681,475 B2
(45) Date of Patent: Jan. 27, 2004

(54) METHOD OF SEALING A MEDICAL CONTAINER WITH A PLASTIC CLOSURE

(75) Inventors: Jean-Claude Thibault, Saint Egreve (FR); Hubert Jansen, Jarrie (FR); Volker Niermann, Little Falls, NJ (US)

(73) Assignee: Becton Dickinson and Company, Franklin Lakes, NJ (US)

( * ) Notice: Subject to any disclaimer, the term of this patent is extended or adjusted under 35 U.S.C. 154(b) by 260 days.

(21) Appl. No.: 09/732,538

(22) Filed: Dec. 8, 2000

(65) Prior Publication Data

US 2002/0010995 A1 Jan. 31, 2002

Related U.S. Application Data

(63) Continuation-in-part of application No. 09/168,502, filed on Oct. 8, 1998.
(60) Provisional application No. 60/082,372, filed on Apr. 20, 1998.

(51) Int. Cl.[7] ..... B21D 39/00
(52) U.S. Cl. ..... 29/511; 53/410; 215/249
(58) Field of Search ..... 29/511, 505, 508, 29/510, 283.5; 215/249, 247, 327, 324; 604/411, 403, 405, 414, 126; 53/410, 416, 420, 422, 483, 486

(56) References Cited

U.S. PATENT DOCUMENTS

| | | | | |
|---|---|---|---|---|
| 1,440,986 A | | 1/1923 | Hammer | 215/327 |
| 2,708,050 A | | 5/1955 | Luertzing et al. | 215/324 |
| 2,902,809 A | | 9/1959 | Wysocki | |
| 3,193,128 A | | 7/1965 | Ravn | 215/42 |
| 3,278,063 A | | 10/1966 | Kranzhoff | 215/38 |
| 3,673,761 A | | 7/1972 | Leitz | |
| 3,974,832 A | | 8/1976 | Kruck | 128/221 |
| 4,226,236 A | | 10/1980 | Genese | 128/218 |
| 4,561,555 A | * | 12/1985 | Miller | 220/611 |
| 4,599,082 A | | 7/1986 | Grimard | 604/90 |
| 4,613,326 A | | 9/1986 | Szwarc | 604/89 |
| 4,944,736 A | | 7/1990 | Holtz | 604/403 |
| 4,968,299 A | | 11/1990 | Ahlstrand et al. | 604/90 |

(List continued on next page.)

FOREIGN PATENT DOCUMENTS

| | | |
|---|---|---|
| EP | 0098810 | 4/1987 |
| FR | 1 328 635 | 4/1963 |
| WO | 9504685 | 2/1995 |
| WO | WO 97/39720 | 10/1997 |

*Primary Examiner*—Gregory Vidovich
*Assistant Examiner*—Stephen Kenny
(74) *Attorney, Agent, or Firm*—David M. Fortunato

(57) ABSTRACT

A method of sealing a medical container such as a vial with a polymeric closure, wherein the polymeric enclosure includes a tubular collar portion and an integral radial portion, which includes disposing the tubular collar portion over the radial rim portion of the container to surround the reduced diameter neck portion and radially deforming the tubular collar portion adjacent its free end into the reduced diameter neck portion and against the adjacent radial rim portion and, wherein the polymer selected for the closure is sufficiently malleable to permit radial deformation, yet sufficiently rigid to retain its shape following deformation and sufficiently resistant to creep to maintain a seal between the plastic closure and the container following radial deformation. In the preferred embodiment of the method, the crimping tool or tools include an inclined surface having a gradually decreasing angle of inclination, which is driven against the tubular collar portion adjacent the free end and the container and vial assembly and crimping tool are relatively rotated. In the most preferred embodiment of the method of this invention, the crimping tool includes an inclined surface or surfaces, which may be separate surfaces or a continuously inclined surface, to gradually and progressively deform the tubular collar portion into the reduced diameter neck portion and against the adjacent radial rim portion in a cold forming process.

29 Claims, 5 Drawing Sheets

U.S. PATENT DOCUMENTS

| | | | | |
|---|---|---|---|---|
| 5,080,649 | A | 1/1992 | Vetter | 604/91 |
| 5,088,612 | A | 2/1992 | Storar et al. | 215/247 |
| 5,137,528 | A | 8/1992 | Crose | 604/415 |
| 5,377,853 | A | 1/1995 | Papciak | 215/230 |
| 5,501,673 | A | 3/1996 | Hjertman et al. | 604/191 |
| 5,549,575 | A | 8/1996 | Giambattista et al. | 604/232 |
| 5,555,988 | A | 9/1996 | Koch et al. | 215/249 |
| 5,561,208 | A | 10/1996 | Takahashi et al. | 526/281 |
| 5,598,938 | A | 2/1997 | Rizzardi | 215/249 |
| 5,718,348 | A | 2/1998 | Manera | 215/249 |
| 5,857,579 | A | 1/1999 | Finneran | 215/252 |
| 6,007,520 | A | 12/1999 | Sudo | 604/181 |
| 6,039,093 | A | 3/2000 | Mrotzek et al. | 141/386 |
| 6,139,534 | A | 10/2000 | Niedospial, Jr. et al. | 604/411 |

* cited by examiner

Fig-7
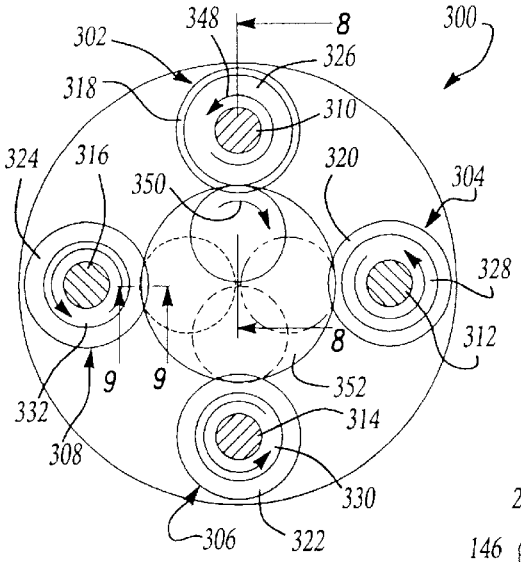
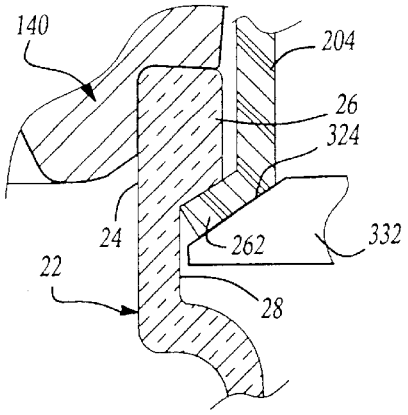
Fig-9
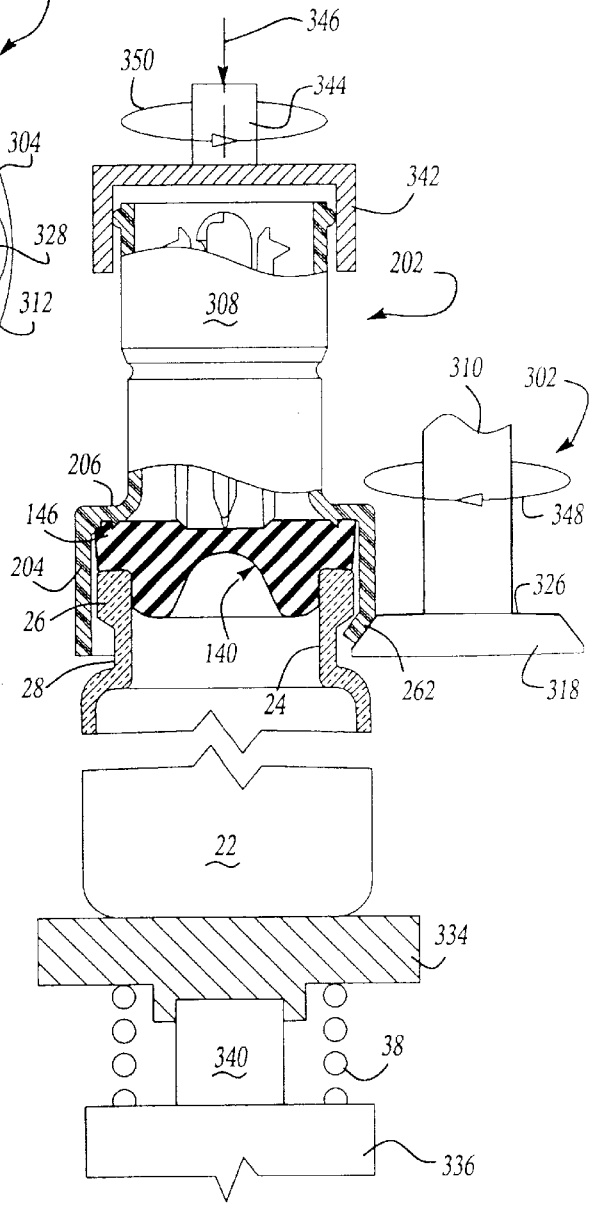
Fig-8

METHOD OF SEALING A MEDICAL CONTAINER WITH A PLASTIC CLOSURE

CROSS-REFERENCE TO RELATED APPLICATIONS

This Application is a continuation-in-part of U.S. application Ser. No. 09/168,502, filed Oct. 8, 1998, which claims priority under 35 U.S.C. Section 119(e) to U.S. Provisional Application Ser. No. 60/082,372, filed Apr. 20, 1998.

FIELD OF THE INVENTION

This invention relates to an improved method of sealing a medical container, such as a vial containing a medicament, drug or vaccine, which eliminates the problems associated with malleable metal caps or collars, such as aluminum. The method of this invention may be used to seal a vial having an elastomeric stopper with a polymeric closure or collar. The method of this invention may also be used for sealing a vial or other medical container with a fluid transfer set separate from or integral with the collar portion of the closure.

BACKGROUND OF THE INVENTION

It is conventional to store medicaments, drugs or vaccines in a sealed vial or other container for later use. Such medicaments, drugs or vaccines may be in a dry or powdered form to increase the shelf life of the drugs and reduce inventory space. Such dry or powdered medicaments, drugs or vaccines are generally stored in a sealed vial and reconstituted in liquid form for administration to a patient by adding a diluent or solvent. Alternatively, the medicament, drug or vaccine may be in liquid or even gaseous form. A conventional vial for storing medicaments generally includes an open end, a radial rim portion surrounding the open end and a reduced diameter neck portion adjacent the rim portion. The vial is conventionally sealed with an elastomeric stopper or septum which generally includes a tubular portion inserted into the neck of the vial and a planar radial rim portion which overlies the vial rim. The stopper is normally secured to the vial with a thin malleable metal cap, such as aluminum. The aluminum cap includes a tubular portion which surrounds the rim portions of the stopper and vial, an inwardly projecting annular portion which overlies the rim portion of the stopper and a distal end portion which is crimped radially into the vial neck beneath the vial rim portion. Because aluminum is malleable, the collar accommodates the buildup of tolerances of the dimensions of the stopper and vial rim. The dimensions and tolerances of standard vials and stoppers are set by the International Standards Organization (ISO).

The radial portion of the aluminum cap which overlies the stopper rim portion may be closed, in which case the aluminum cap is removed by "peeling" the aluminum cap from the vial. A pre-slit tab located in the middle area may be provided which overlies the vial rim, permitting the cap to be torn from the top and peeled from the vial prior to use. This closed embodiment of an aluminum cap has several disadvantages. First, the tearing of the metal cap creates sharp edges which may cut or damage sterile gloves and cut the person administering the drug, thereby exposing both the healthcare worker and the patient to disease and contamination of the drug. Second, the tearing of the aluminum cap generates metal particles which may also contaminate the drug, medicament or vaccine. The dangers associated with the tearing of an aluminum cap has been solved in part by adding a "flip-off" plastic cap. In one such embodiment, the aluminum collar includes a central opening and a shallow plastic cup-shaped cap is received over the aluminum collar having a central projecting riveting portion which is received and secured in the central opening of the aluminum collar. The plastic cap is then removed by forcing the flip-off cap away from the aluminum collar, which tears an annular serrated portion surrounding the central opening and exposes an opening in the collar for receipt of a hypodermic needle or the like. This embodiment reduces but does not eliminate the possibility of tearing the sterile gloves of the healthcare worker. More importantly, however, aluminum dust is still created which may contaminate the medicament. It is also important to note that metallic dust is also created simply by forming and affixing the aluminum collar to the vial because aluminum dust is created in forming the aluminum collar, crimping of the collar and removal of the flip-off plastic cap.

Aluminum collars have also been used to secure a fluid transfer set on medicament vials. Transfer sets may be utilized, for example, to transfer fluid from a syringe to a vial, such as to reconstitute a dry or powdered drug in a vial by adding a diluent or solvent. The reconstituted drug may then be withdrawn from the vial by the syringe. The inner surface of the transfer set may be part of the drug fluid path and the aluminum collar or ring may bring aluminum particles in the sterile room where the drug is added to the vial or into the drug fluid path contaminating the drug. There have been attempts to reduce this problem by applying a coating, such as a polymeric coating, to the aluminum cap or collar. Finally, the prior art also includes snap-on cup-shaped plastic caps or collars having a radially inwardly projecting end portion which is snapped over the rim portion of the vial. Snap-on plastic collars, however, do not assure adequate sealing of the vial or fully accommodate the tolerances of standard vials and stoppers as required.

The need therefore remains for a method of sealing vials and other medical containers which may be utilized for sealing conventional medical containers, such as medicament vials or cartridges, which assures sealing of the container and which achieves a good level of cleanliness, without metal particles or dust which will contaminate the medicament, drug or vaccine, the transfer set or clean room and which does not expose the health care worker to sharp edges. The method of sealing a medical container of this invention eliminates these problems and permits sealing of medical containers in an aseptic environment.

SUMMARY OF THE INVENTION

As set forth above, the method of sealing a vial or other medical container with a plastic closure of this invention eliminates the problems associated with malleable metal or aluminum caps or collars, but which accommodates buildup of tolerances of the rim portion of the container and the elastomeric stopper, when used. The plastic or polymeric closure of this invention is relatively inexpensive to manufacture and use in the method of this invention. The method of this invention may be utilized to seal a conventional medical vial with a polymeric cap, a collar in combination with a flip-off cap or with a collar used to secure and seal a transfer set on a vial for transferring fluid between the vial and a second container, such as a hypodermic syringe. As used herein, the term "closure" is generic to either a cap or collar alone or in combination with a transfer set.

As stated above, the method of sealing a container with a plastic closure of this invention may be utilized with a conventional vial or other medical container having an open end, a radial rim portion surrounding the open end and a reduced diameter neck portion adjacent the rim portion. The method of sealing a medical container with a plastic closure of this invention includes forming a plastic closure from a polymer, preferably formed by injection molding, which is sufficiently malleable to permit radial deformation, yet sufficiently rigid to retain its shape following deformation and sufficiently resistant to creep to maintain a seal between the plastic closure and the container following radial deformation. The plastic closure formed by the method of this invention includes a generally cylindrical tubular portion having an internal diameter generally equal to or preferably slightly greater than an outside diameter of the rim portion of the container and an integral radial rim portion. In the preferred method of this invention, the plastic closure is formed by injection molding a polymer alloy comprising a relatively malleable soft polymer and a relatively rigid polymer. The closure may be formed by co-injecting a polymer alloy which preferably includes a polycarbonate as the relatively rigid polymer.

The method of this invention then includes telescopically disposing the tubular portion of the closure over the rim portion of the container with the radial rim portion of the closure overlying the rim portion of the container and the generally cylindrical tubular portion surrounding the container rim having a free end surrounding the reduced diameter neck portion of the container. The tubular portion of the closure adjacent the free end is then deformed radially inwardly into the neck portion of the container beneath the rim portion and preferably against the rim portion adjacent the neck portion, permanently securing the closure on the container and sealing the container open end, wherein the free end of the plastic closure retains its shape beneath the radial rim portion following deformation and the polymer is sufficiently resistant to creep to permanently maintain the seal. In the preferred method of sealing a vial having medicament, drug or vaccine therein, the vial is initially sealed with an elastomeric stopper having a tubular portion received in the open end of the vial and a planar rim portion which overlies the rim portion of the vial. The method of this invention then preferably includes compressing the radial rim portion of the plastic closure against the radial portion of the stopper to seal the plastic closure to the stopper and substantially simultaneously radially deforming the free end of the closure tubular portion into the reduced diameter neck portion of the vial as described above.

In the preferred method of sealing a container, such as a medical vial, with a plastic or polymeric closure of this invention, the cylindrical tubular portion of the closure is deformed radially into the neck portion of the container using a crimping tool having an inclined, chamfered or tapered surface and the vial or container and the crimping tool are relatively rotated and driven together to deform the tubular portion of the closure both radially into the neck portion of the collar and axially against the adjacent rim portion of the container to permanently secure the closure on the container and seal the container. In one preferred embodiment of the method of this invention, the crimping tool includes a frustoconical chamfered surface which is rotated and driven against the tubular portion of the closure, crimping the collar as described. In this embodiment, the container or vial may be simultaneously rotated to crimp and seal the entire periphery of the rim portion. In another embodiment, the crimping tool includes an arcuate or circular stationary rail having an inclined or frustoconical chamfered surface and the method of crimping the closure includes simultaneously driving the vial and closure assembly against the rail and rotating the vial to crimp the tubular portion of the closure radially inwardly into the reduced diameter neck portion and axially against the adjacent rim portion of the container as described. In either embodiment, the method is preferably a cold forming process dependent upon the material of the polymeric closure, which as described as above is sufficiently malleable to permit radial deformation, yet sufficiently rigid to retain its shape following deformation and sufficiently resistant to creep to maintain the seal between the plastic closure and the container following radial deformation.

In both preferred embodiments of cold forming the free end of the plastic closure into the reduced diameter neck portion of the vial or other container, the free end of the tubular collar portion is preferably gradually or incrementally deformed radially into the neck portion to assure permanent deformation, reduced creep and reduce damage to the closure, such as stress cracking or discoloration of a clear plastic closure. In the first embodiment of the method of this invention described above, the free end of the tubular closure is deformed incrementally by a series of rotating crimping tools, wherein the first tool has a relatively steep angle of inclination, such as 45 degrees. The angle of inclination of the next crimping tool is then reduced, etc. to the desired angle of the deformed lip, which may be, for example, 20 to 30 degrees. In the second embodiment of the method of this invention described above, the angle of inclination of the crimping surface of the rail is gradually reduced as the vial or other container is rolled or rotated along the rail gradually cold forming the free end of the closure and avoiding damage to the closure including cracking and discoloration.

Where the method of sealing a vial or other medical container of this invention is utilized to seal a transfer set on a vial or other medical container, the closure may take the form of a collar having a second tubular portion extending from the radial rim portion of the collar, generally coaxially aligned with the tubular collar portion received on the rim portion of the container. In the method of sealing a transfer set on a vial or other medical container, the components of the transfer set are assembled before crimping of the collar on the medical container, preferably in an aseptic or sterile environment. In the preferred embodiment, the transfer set includes a piercing member which is telescopically supported in the second tubular portion of the closure for piercing an elastomeric stopper in the open end of the container or vial. One important advantage of the method of sealing a vial or other medical container of this invention is that the container may be a conventional medical vial, as described above, having a conventional elastomeric stopper. A conventional elastomeric stopper has a tubular portion which is press fit into the open end of the vial and a radial planar portion which overlies the rim portion of the vial. The transfer set may also include a tubular transfer member which telescopically receives the piercing member and which may be integral with the second tubular portion of the closure or separate from the collar portion and secured by the collar portion. Finally, the preferred embodiment of the transfer set also includes a cap which seals the open end of the second tubular portion of the collar.

The method of sealing a transfer set on a vial or other medical container with a plastic closure of this invention then includes first assembling the transfer set, including telescopically supporting the piercing member within the second tubular portion of the closure. As described above, the closure includes a tubular collar portion having an inside diameter generally equal to or preferably slightly greater than the outside diameter of the radial rim portion of the container or vial, a radial portion and a second tubular portion which is coaxially aligned with the tubular collar portion of the closure. The closure is then assembled on the vial or other medical container by telescopically receiving the tubular collar portion of the closure over the rim portion of the container such that the tubular collar portion surrounds the rim portion of the container and at least a portion of the reduced diameter neck portion. The second tubular portion of the closure and the piercing member are now coaxially aligned with the open end of the vial or other medical container and moveable relative to the elastomeric stopper to pierce the stopper. The method of this invention then includes radially deforming the tubular collar portion of the closure adjacent the free end into the reduced diameter neck portion of the container and against the adjacent radial rim portion, permanently securing the closure on the container and sealing the container as described above. That is, the tubular collar portion is preferably gradually or incrementally deformed or cold formed as described above. In the most preferred embodiment of the method of sealing a transfer set on a vial of this invention, the radial portion of the closure is simultaneously compressed against the radial planar rim portion of the elastomeric stopper as the tubular collar portion is crimped in the neck portion of the container and the piercing member is telescopically supported in the second tubular portion of the closure for telescopic movement to pierce the planar rim portion of the elastomeric stopper and provide fluid communication between the vial or other medical container and the tubular transfer portion of the transfer set. The tubular transfer member may also include a Leur threaded connection for receipt of a threaded Leur connection of a second container, such as a syringe.

As set forth above, the method of sealing a container with a plastic closure of this invention utilizes a polymer for the closure having the requisite physical properties to provide and maintain a seal between the plastic closure and the vial or other medical container and permanently secure the closure on the container. In the preferred embodiment, the plastic closure is formed of a polymer alloy or melt blend which includes a relatively tough soft malleable copolymer and a relatively rigid copolymer. In the most preferred embodiment, the composite polymer is a polymeric alloy of a relatively soft malleable copolymer and a relatively rigid polymer. The preferred rigid polymer is a polyamid or a polycarbonate and the preferred relatively soft copolymer may be selected from polyesters or polyolefins. The resultant polymer alloy or composite preferably has an elongation at yield between 5% and 10% and an elongation at break greater than 100% with a flectural modulus of greater than 1,900 MPa.

The method of this invention thus eliminates the problems and hazards associated with the use of a malleable metal closure or collar, such as aluminum, and plastic coated aluminum caps or collars while assuring sealing of the container or damage to the plastic closure. In the most preferred embodiment of the method of this invention, the plastic closure or collar is formed by injection molding the plastic closure from a polymeric alloy or composite as described. A thermoplastic elastomer may also be co-injected with the polymer forming the closure to form a coating or film on the inside surface of the closure, which is integrally bonded to the polymer of the closure. As used herein, the terms "composite" and "alloy" are used in their broadest sense to include alloys or melt blends, composites and copolymers.

Other advantages and meritorious features of the method of sealing a vial or other medical container with a plastic closure or collar of this invention will be more fully understood from the following description of the preferred embodiments, the appended claims and the drawings, a brief description of which follows.

BRIEF DESCRIPTION OF THE DRAWINGS

FIGS. 7 to 9 illustrate one method of crimping the transfer set shown in FIGS. 5 and 6, wherein FIG. 7 is a perspective top view;

FIG. 8 is a partially crosssectioned side view of FIG. 8 in the direction of view arrows 8—8; and FIG. 9 is an enlarged side partially cross sectioned view of FIG. 7 in the direction of view arrows 9—9;

FIGS. 10 to 13 illustrate an alternative method of sealing the transfer set on a vial shown in FIGS. 5 and 6, wherein FIG. 10 is a top perspective view and FIGS. 11 to 13 are a side partially cross sectioned views in the direction of view arrows 11—11, 12—12 and 13—13.

DETAILED DESCRIPTION OF A PREFERRED EMBODIMENT

Figure 1:
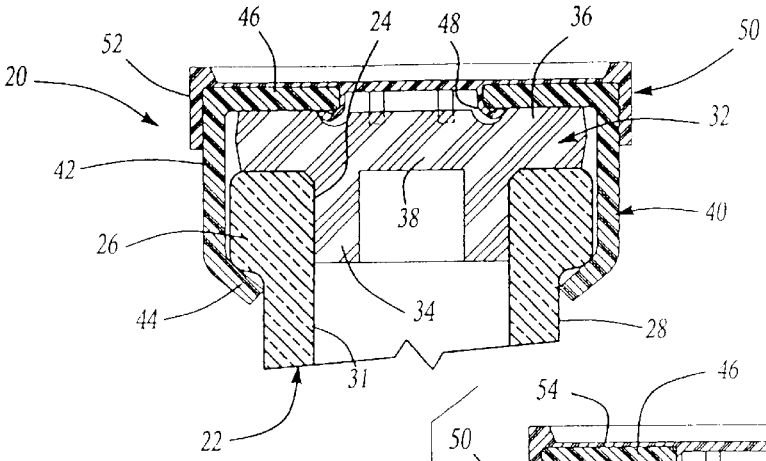
FIG. 1 is a side crosssectional side view of a plastic closure secured to a conventional vial in sealed relation by the method of this invention.
Figure 2:
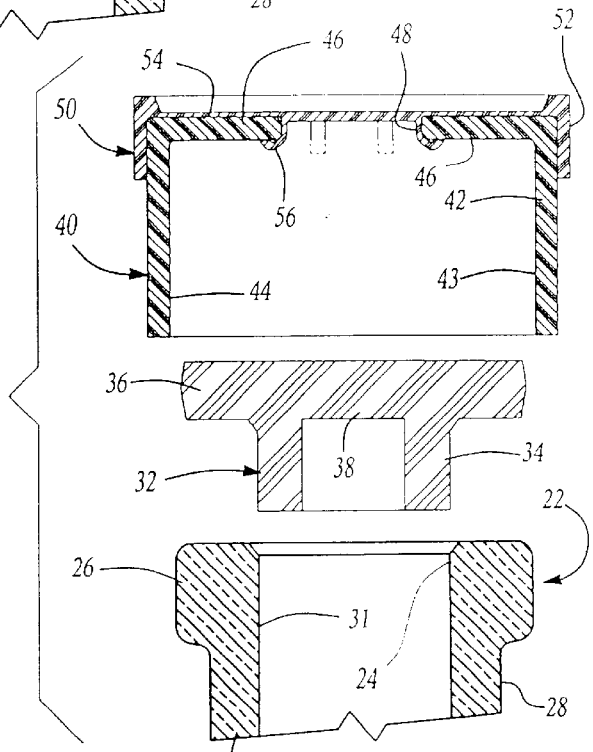
FIG. 2 is an exploded side crosssectional view of the components of the assembly shown in FIG. 1 illustrating the method of assembling the closure on the vial.
Figure 3:
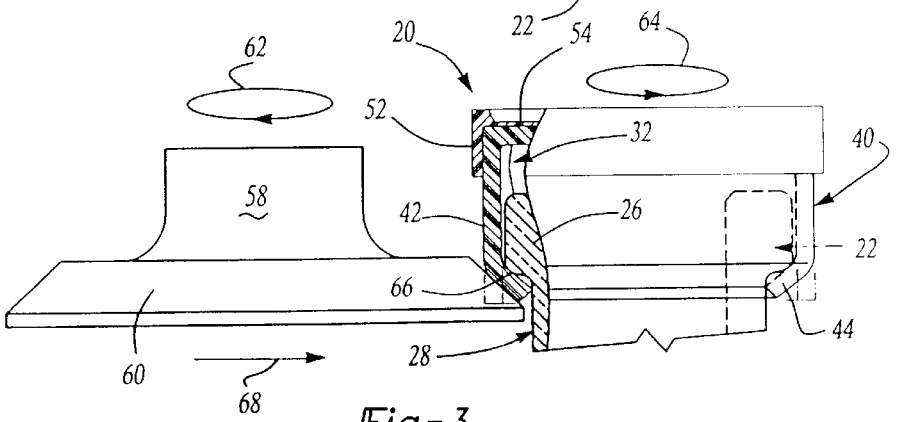
FIG. 3 is a partially crosssectioned side view of the assembly shown in FIGS. 1 and 2 illustrating one embodiment of the method of crimping the closure on the vial.

FIGS. 1 to 3 illustrate one preferred embodiment of the vial, stopper and closure assembly 20 of this invention. As set forth above, the method of this invention may be utilized to seal various containers and is particularly useful for sealing medicament containers such as the conventional vial 22 illustrated in FIGS. 1 to 3. The vial includes an open end 24, an annular radially extending rim portion 26 and a reduced diameter neck portion 28 adjacent the rim portion. As shown, the neck portion 28 of the vial has a reduced diameter when compared to the rim portion 26 and the container portion 30 shown in FIG. 4. The internal surface 31 of the vial adjacent the open end 24 is generally cylindrical. Medical vials of this type are generally formed of glass or a sterilizable plastic. The open end 24 of the vial is typically closed with an elastomeric stopper 32 having a tubular body portion 34 which is received in the open end 24 of the vial and a planar rim portion 36 which overlies the rim portion 26 of the vial as shown in FIG. 1. The stopper is generally formed of a resilient elastomeric material such as synthetic or natural rubber. The central portion 38 of the planar rim portion 36 may be pierced with a hypodermic needle, for example, to either withdraw fluid from the vial or add a solvent or diluent to the vial where the medicament, drug or vaccine in the vial is a dry or powder material. The tubular portion 34 of the elastomeric stopper has an external diameter slightly greater than the internal diameter of the internal cylindrical surface 31 of the vial to provide a tight or interference fit.

One preferred embodiment of the closure 40 is shown in FIG. 1 attached to a vial 22 and stopper 32 assembly, prior to assembly in FIG. 2 and during assembly in FIG. 3. This embodiment of the closure 40 includes a tubular collar portion 42 which surrounds the rim portion 26 of the vial and the planar rim portion 36 of the stopper. Where the external surface of the rim portion 26 of the vial is cylindrical, the tubular collar portion 42 of the closure will generally also be cylindrical. As shown in FIG. 1 and described below, the free end 44 of the tubular collar portion 42 is deformed inwardly or crimped into the reduced diameter neck portion 28 and against the adjacent surface of the rim portion 26 of the vial, permanently securing the collar 40 on the vial and sealing the vial. The preferred embodiment of the closure 40 also includes an integral radial proximate portion 46 which overlies the rim portions 26 and 36 of the vial and stopper, respectively. The radial portion 46 is preferably integral with the tubular collar portion 42 of the closure. This embodiment of the closure 40 also includes a central opening 48 which overlies the central portion 38 of the stopper, preferably coaxially aligned with the central portion of the stopper. As described below, however, the central opening 48 may be eliminated in certain applications of this invention. As used herein, the terms proximate and distal are used solely for ease of description, wherein the term proximate refers to elements or portions of elements closest to the rim portion 36 of the stopper and distal refers to elements or portions of elements more remote from the rim portion of the stopper. Further, the terms cap and collar are sometimes used herein interchangeably. The term cap, however, generally refers to a closure having a radial portion which overlies the container opening and collar is sometimes used to refer to a closure used to secure an element, such as a transfer set, to the container.

In this disclosed embodiment, the closure 40 includes a shallow cup-shaped cap 50. In the disclosed embodiment, the cap 50 includes a tubular portion 52 which surrounds the proximate portion of the tubular portion 42 of the closure, an integral central radial bridging portion 54 and a plurality of U-shaped tabs which, in the disclosed embodiment, are integral with the central bridging portion 54. The U-shaped tabs 56 are received through the central opening 48 of the closure and snap in place to securely retain the cap 50 on the closure 40. As shown in FIG. 2, the cap 50 is preferably preassembled on the closure 40 prior to assembly of the closure on the vial. The tabs 56 may also be separate members or the central portion of the cap 50 including the tabs 56 may be a separate member.

The closure 40 is then assembled on the vial 22 as shown in FIG. 2. In a typical application, the tubular portion 34 of the stopper is first inserted into the opening 24 of the vial 22, generally after the vial is filled. As set forth above, the plastic closure 40 of this invention may be used with various containers including conventional medical vials as shown. Thus, in a typical application, the vial 22 will first be filled with a medicament, vaccine or drug. The tubular portion 42 of the closure 40 is then received over the rim portion 36 of the stopper and the rim portion 26 of the vial as shown in FIG. 3 and describe below.

A method of crimping the collar or closure 40 on the vial 22 is shown in FIG. 3. The free end 44 of the tubular collar portion 42 of the closure is crimped on the vial by a crimping tool 58 having an inclined or tapered surface 60 which, in the disclosed embodiment, is frustoconical. The crimping tool 58 is rotated in one direction as shown by arrow 62 and in one embodiment, the assembly of the closure 40 and vial 22 is rotated at the same speed in the opposite direction as shown by arrow 64. The inclined frustoconical surface 60 is driven against the tubular portion 42 of the closure as shown by arrow 68, which deforms the free end 44 radially inwardly against the reduced diameter neck portion 28 and against the rounded edge 66 of the rim portion 26 adjacent the neck portion 28. The radial portion 46 of the closure may be simultaneously compressed against the planar radial rim portion 36 of the elastomeric stopper 32 to assure complete sealing of the vial. In the preferred method of sealing a medical container with a closure of this invention, the tubular portion 42 is crimped into the reduced diameter neck portion 28 by cold forming. That is, the crimping tool 58 is not heated to soften or partially melt the polymeric closure as would be required with certain polymers. Thus, as described below, the preferred polymer for the closure is selected based upon its physical properties, as described above. In the most preferred embodiment of the method of sealing a medical container with a closure of this invention, the tubular portion 42 of the closure is gradually or incrementally deformed into the reduced diameter neck portion 28 of the vial using a plurality of crimping tools having different degrees of inclination or pitch or the rim portion is deformed against a crimping tool having a gradual change of pitch as described below with regard to FIGS. 7 to 9 and 10 to 13, respectively.

When the vial is ready for use, the cap 50 may be removed simply by forcing one side of the cap 50 upwardly away from the closure 40, removing the cap 50 from the closure 40 and exposing the central opening 48 of the closure and the central portion 38 of the stopper. The central portion 38 of the stopper may then be pierced with a conventional hypodermic needle, for example, providing access to the container portion 30 of the vial. Where the material of the cap 50 is selected to provide resiliency, such as polyethylene or polypropylene, the tabs 56 will bend under thumb pressure, permitting easy removal of the closure 50. Alternatively, where the material of the cap is relatively rigid, at least some of the tabs 56 will break, also permitting removal of the cap. As noted above, the radial portion 46 of the closure is preferably compressed against the resilient rim portion 32 of the elastomeric stopper during radial deformation of the free end 44 of the collar portion to assure a secure seal of the vial following installation. The tabs 56 are thus compressed into the radial rim 32 of the stopper as shown in FIG. 1.

The polymer selected for the plastic closure and method of this invention can best be described by its required physical properties. The polymer must be sufficiently malleable to permit radial deformation or crimping, yet sufficiently rigid to retain its shape following deformation. The polymer must also be sufficiently resistant to creep to maintain the seal between the plastic collar portion and the container following radial deformation. It has been found that a polymer having an elongation at yield between 5% and 10% and an elongation at break greater than 100%, combined with a flexural modulus of greater than 1900 MPa has superior performance. Where the plastic closure of this invention is utilized for sealing vials containing a medicament, vaccine or drug, the polymer should also be sterilizable and, in certain applications such as the plastic closure for a vial transfer set described below, the polymer is preferably relatively clear and maintains its clarity under the stress of deformation or crimping. It has been found that certain polymer alloys or composite polymers including melt blends or alloys and co-polymers having polymers of different malleability and rigidity are preferred in many applications. That is, the plastic closure used in the method of this invention is preferably formed of a polymer alloy, composite polymer or co-polymer including a relatively rigid polymer and a tough relatively soft malleable co-polymer. The most preferred polymer is a polymer alloy or melt blend including a polyamid or polycarbonate as the rigid polymer providing the strength and resistance to creep desired for this application. The relatively soft malleable co-polymer may be selected from various polymers including polyesters and polyolefins; however, a polymer alloy including a polycarbonate or polyamid and a polyester has been found particularly suitable for this application.

As will be understood, various polymeric melt blends, alloys, composites and co-polymers are being developed on a rapidly increasing basis and therefore the plastic collar of this invention is not limited to a specific polymer, provided the polymer has the desired physical properties described above. Suitable polymers for the plastic closures of this invention include EASTAR® MB polymers, which are melt blend and alloy polymers and EASTAR® thermoplastic polymers, which are neat polymers sold by Eastman Chemical Company of Kingsport, Tenn. and Eastman Chemical AG of Zug, Switzerland under the trade names "DA003, DN003" and "DN004". These materials are polymeric melt blends, alloys and co-polymers of polycarbonate or polyamid and polyester. As used herein, the terms melt blends and alloys refer to polymeric compositions having two or more polymers of different physical properties or characteristics, such as the EASTAR® polymers of Eastman Chemical Company described above which include a polycarbonate or polyamid and a polyester. The polymer selected for the plastic collar of this invention may also include fillers and other constituents which would be more accurately described as a composite, although the base polymers may still be a polymeric melt blend or alloy. As used herein, the term alloy is used in its broadest sense to include alloys or melt blends, composites and co-polymers. As will be understood, the manufacturer or supplier of the raw material will normally blend the polymers based upon the specifications of the customer. The polymers may be co-injected to form a polymeric melt blend, alloy or composite or formed by any other suitable processes. It is anticipated, however, that other polymers having the described physical characteristics may also be utilized in the plastic collar or cap of this invention. In certain applications, it may also be desirable to coat at least the interior surface 43 of the collar shown in FIG. 2 with a thermoplastic elastomer, or the entire collar may have a thin layer of a thermoplastic elastomer. The thermoplastic elastomer coating may be applied as a film or by co-injection with the polymer forming the collar 40. The closure 40 and the cap 50 may be formed by injection molding.

Figure 4:
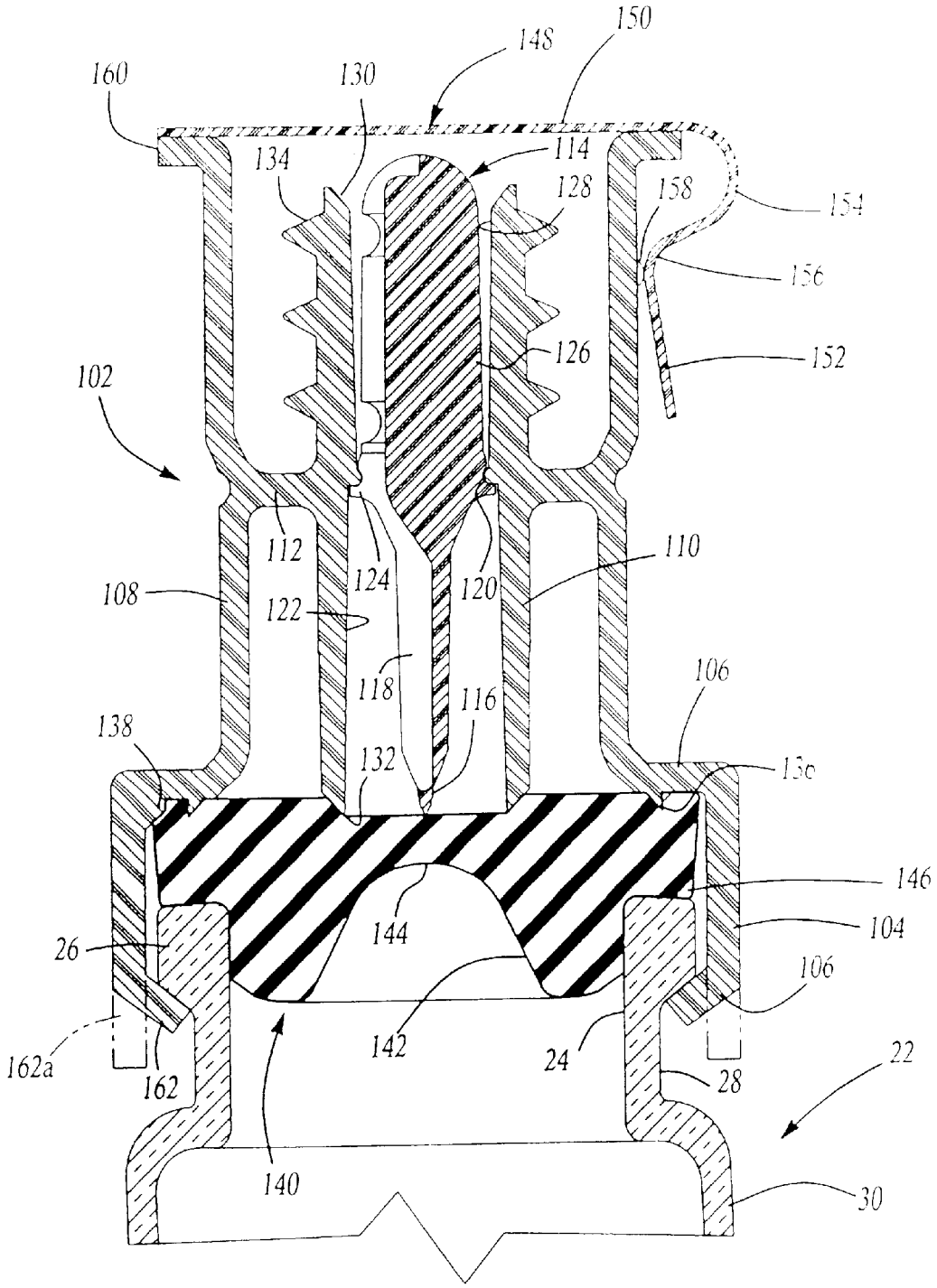
FIG. 4 is a crosssectional view of one embodiment of a vial and transfer set assembly formed by the method of this invention.

FIG. 4 illustrates one embodiment of a vial and transfer set assembly, wherein the collar portion of the transfer set is secured to the vial by the method of this invention. The transfer set 102 in FIG. 4 includes a tubular collar portion 104, an integral radial portion 106 and a second tubular portion 108 which is integral with the radial portion 106 and coaxially aligned with the tubular collar portion 104 as shown. The preferred embodiment of the transfer set 102 also includes a tubular transfer member 110 which, in the disclosed embodiment, is integral with the second tubular portion 108 by the radial bridging portion 112. The transfer set further includes a piercing member 114 which is telescopically received in the tubular transfer member 110 and includes a piercing end 116 and a longitudinal channel 118 which provides communication between the vial 22 and the tubular transfer member 110 as described hereinbelow. The piercing member 114 is releasably retained in the tubular transfer member 110 by a radial rim 120 extending from the internal surface 122 of the tubular transfer member 110 and an annular groove 124 in the enlarged end portion 126 of the piercing member. The internal surface 128 of the tubular transfer member adjacent the open distal end 130 may be slightly tapered or conical to assist in the assembly of the piercing member 114 in the tubular transfer member 110 as described further below. The proximate end of the tubular transfer member 110 preferably includes a relatively sharp annular edge 132 to seal the communication provided by the piercing member and the outer distal surface may include Leur threads 134 to threadably receive a second container such as a syringe, not shown, discussed further below. In the disclosed embodiment, the radial portion 106 also includes an annular projection having a sharp edge 136 providing an additional seal for the transfer set and the disclosed embodiment includes radially projecting ribs 138 bridging the tubular collar portion 104 and the radial portion 106 which prevent relative rotation of the transfer set and the vial.

The elastomeric stopper 140 shown is also conventional in this field. The elastomeric stopper includes a generally tubular portion 142 which is received in the open end 24 of the vial 22 with an interference fit, wherein the outer diameter of the tubular portion 142 is slightly greater than the internal diameter of the open end 24 of the vial as described above. The stopper further includes a reduced thickness portion 144, which is pierced by the piercing end 116 of the piercing member 114, as described below, and a planar rim portion 146 which overlies the rim 26 of the vial. As shown in FIG. 4, the second tubular portion 108 and the tubular transfer member 110 are coaxially aligned with the open end 24 of the vial following assembly and the piercing member 114 is generally centrally located on the stopper 140 opposite the reduced thickness portion 144. The disclosed embodiment of the transfer set 102 further includes a cap 148 having a central portion 150 bridging the open end of the second tubular portion 108, a finger tab 152, an arcuate portion 154 and a mid portion 156 which may be adhesively bonded to the second tubular portion 108 as shown at 158. In a disclosed embodiment, the distal end of the second tubular portion 108 includes a radial flange 160 which receives the central portion 148 of the cap which may be adhesively bonded to the radial flange portion 160. As described above in regard to FIG. 3 and below in regard to FIGS. 7 to 11, the tubular collar portion 104 adjacent the free end 162 is deformed radially inwardly into the reduced diameter neck portion 28 and against the adjacent surface of the radial rim portion 26, permanently retaining the tubular collar portion 104 and the transfer set 102 on the vial as shown in FIG. 4.

The assembly and use of the transfer set 102 and vial assembly may now be briefly described, as follows. First, the piercing member 114 is assembled in the tubular transfer member 110, wherein the interlocking rim 120 and groove 124 releasably retains the tubular transfer member in the position shown. The cap 148 may be preassembled on the second tubular portion 108 by adhesive bonding as described, but is preferably added after assembly, at the transfer set on the vial. The transfer set is then assembled on the vial by telescopically receiving the tubular collar portion 104 on the rim portion 26 of the vial, wherein the free end 162*a* (shown in phantom) is received around the reduced diameter neck portion 28 as shown. The free end 162 of the tubular collar portion is then deformed into the reduced diameter neck portion 28 as described above or as described below in regard to FIGS. 7 to 11. The vial and transfer set assembly is now ready for use.

As set forth above, the vial 22 may contain, for example, a dry or powdered substance, such as medicaments, drugs or vaccines, and wherein the dry substance may be reconstituted in liquid form for administration to a patient by adding a diluent or solvent. In this application, the cap 148 is removed by pulling the pull tab 152 which first breaks the adhesive bond 158 and then the adhesive bond of the central portion 150 on the radial flange exposing the tubular transfer member 110 and the piercing member 114. Where the dry substance is to be reconstituted with liquid from a syringe, for example, the barrel portion of the syringe (not shown) is threaded onto the Leur connector threads 130, which drives the tip portion of the syringe against the piercing member 114. The piercing member is then driven through the reduced thickness portion 144 of the elastomeric stopper providing fluid communication between the syringe and the vial 22. Where the vial contains a powdered substance as described, fluid from the syringe may then be forced through the longitudinal channel 118 of the piercing member into the vial, the powdered substance reconstituted and withdrawn by the syringe, as is well known in this art.

Figure 5:
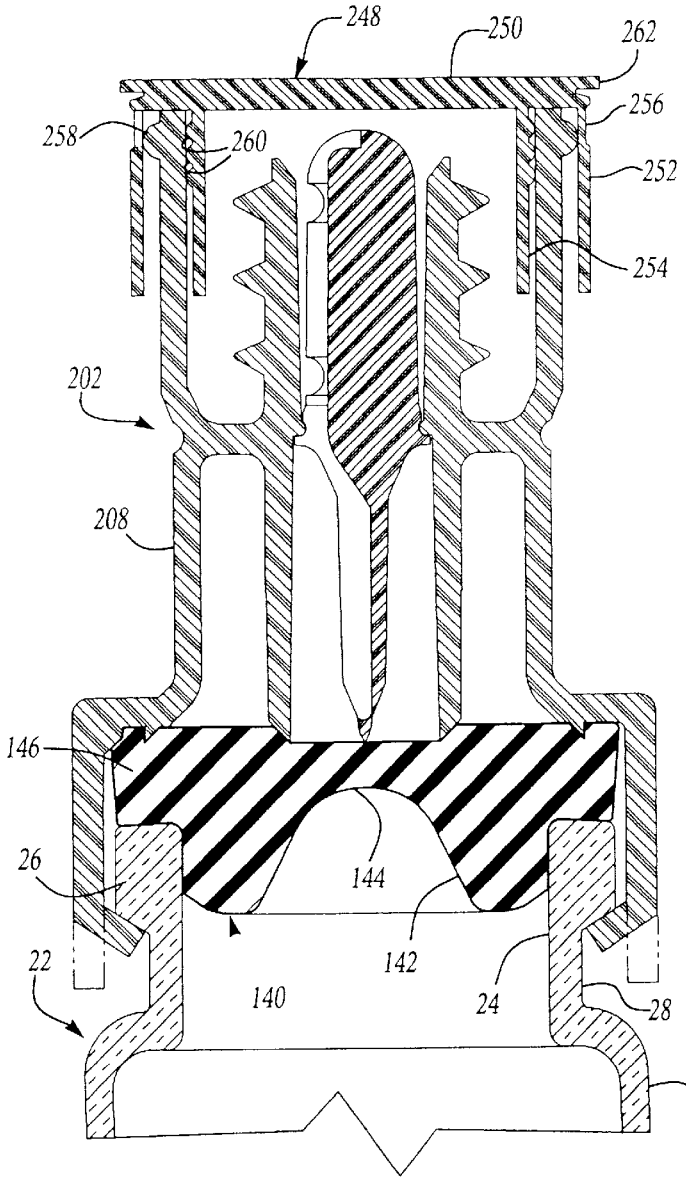
FIG. 5 is a side crosssectional view of an alternative embodiment of a transfer set and vial assembly formed by the method of this invention.
Figure 6:
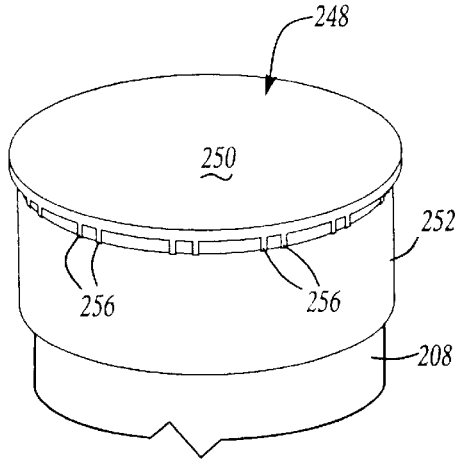
FIG. 6 is a partial top perspective view of the transfer set assembly shown in FIG. 5.
Figure 10:
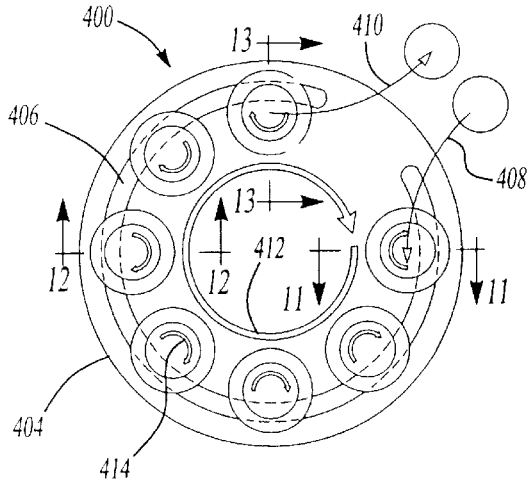

FIGS. 5 and 6 illustrate an alternative embodiment of a transfer set 202 which includes an improved cap 248 as described below. Otherwise, the transfer set 202 may be identical to the transfer set 102 described above in regard to FIG. 4 and the components of the transfer set, vial 22 and elastomeric stopper 140 are numbered in the same sequence, except that the components are numbered in the 200 series in FIG. 5. Therefore, no further description of these components is required, except as set forth below.

In the embodiment of the cap 248 shown in FIGS. 5 and 6, the central portion 250 bridges the open distal end of the second tubular portion 208 as shown in FIG. 5. The cap further includes an integral outer tubular portion 252 and a concentric inner tubular portion 254 which, in a disclosed embodiment, are cylindrical to receive the distal end of the cylindrical tubular portion 208 as shown in FIG. 5. The outer tubular portion 252 is integrally joined to the central portion 250 by a plurality of spaced frangible portions 256 as best shown in FIG. 7. An integral rim 258 is provided on the exterior surface of the second tubular portion 208 adjacent the distal end and opposite the frangible portions 256 includes a radial rib 258 which facilitates breaking of the frangible portions 256 as described below. In the disclosed embodiment, the interior surface of the inner tubular portion 254 includes a plurality of annual ribs 260 which seals against the interior surface of the second tubular portion 208. Further, the central portion 250 includes a radial rib 262 which permits gripping of the central portion to remove the cap, as now described. When the transfer set 202 is assembled on the vial 22 as described below in regard to FIGS. 7 to 11, the cap is removed by pressing the flange 262 away from the transfer set, which breaks the frangible portions 256, permitting removal of the cap. The cap may be formed of any suitable plastic, include polyethylene and polypropylene or relatively harder polymeric materials.

FIGS. 7 to 13 illustrate alternative methods of crimping the collar or closure on a conventional vial, wherein the embodiment of the transfer set illustrated is as shown in FIGS. 5 and 6 and the collar is gradually or incrementally deformed into the neck portion of the vial by cold forming. The embodiment of the crimping apparatus and method illustrated in FIGS. 7 to 9 may be utilized to seal vials or other containers with a plastic or elastomeric closure up to about 200 vials per minute. The crimping apparatus and method disclosed in FIGS. 10 and 11 may be used for higher volume applications, wherein the through put may be as great as 600 vials per minute.

In the embodiment of the crimping or capping apparatus disclosed in FIGS. 7 to 9, the crimping apparatus 300 includes a plurality of crimping tools, wherein the inclined surfaces of the crimping tools have differing degrees of pitch incrementally deforming the free end 162 of the tubular collar portion as now described. The embodiment of the crimping apparatus 300 shown in FIG. 7 includes four rotatable crimping tools 302 to 308, each having a shaft 310 to 316, respectively, and an inclined or tapered surface 318 to 324, respectively, on the roller portion of the crimping tool 326 to 332, respectively. The pitch or angle of inclination of the inclined surfaces 318 to 324 decreases progressively as the vial progresses through the stations of the crimping apparatus. That is, the pitch of the inclined surface 320 of crimping tool 304 of the second station is less than the pitch of the inclined surface 318 of the crimping tool 302 of the first station, etc.

FIG. 8 illustrates the first station of the crimping apparatus 300. The vial and transfer set assembly is supported on a support member 334, which is preferably resiliently biased to compress the radial portion 206 against the rim portion 146 of the elastomeric stopper 140 during crimping as set forth above. In the disclosed embodiment, the vial 22 is supported on a support member 334, which is supported on a base 336 by piston 340 and is spring biased by a suitable resilient member, such as spring 338. The upper end of the second tubular portion 308 is supported by a cup-shaped support member 342 which is affixed to a rotatable shaft 344. The cup-shaped support member 342 may also be spring biased downwardly as shown by arrow 346. The assembly is then rotated against the rotatable crimping tool 302 in the first station, which includes a rotatable shaft 310 having a roller portion 326. As set forth above, the roller portion 326 includes an inclined or tapered surface 318 which deforms the free end 262 of the tubular collar portion 204 radially inwardly into the reduced diameter neck portion 28 of the vial 22. The relative rotation of the crimping tool 302 and the vial and transfer set assembly is shown by arrows 348 and 350, wherein the crimping tool and vial and transfer set assembly are rotated in opposite directions. As will be understood, however, one of the crimping tool and vial and transfer set assembly may be the drive member and the other may be the driven member wherein only the drive member is rotated and the other member follows. The base 336 is supported in the disclosed embodiment on a turntable 352, as shown in FIG. 7, such that the vial and transfer set assembly is moved from station to station. In the first station, as shown in FIG. 8, the inclined surface 318 has a relatively steep angle, which deforms the free end 262 only partially into the reduced diameter neck portion 28 as shown at the right side of FIG. 8. As set forth above, the inclined surface of the crimping tool at each station is reduced, such that the crimping tool in the final station deforms the free end 262 of the tubular collar portion 204 into and against the reduced diameter neck portion and against the adjacent surface of the rim portion 26 of the vial as shown in FIG. 9. The crimping apparatus 300 thus performs the method of this invention as described above.

Figure 11:
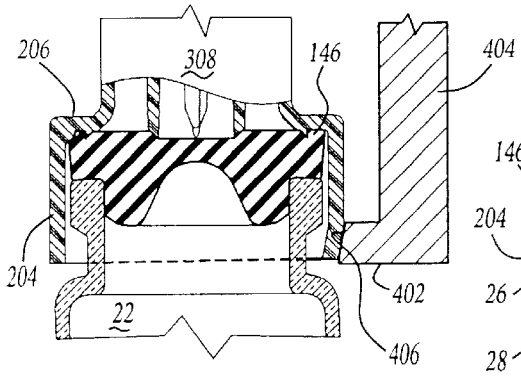
Figure 12:
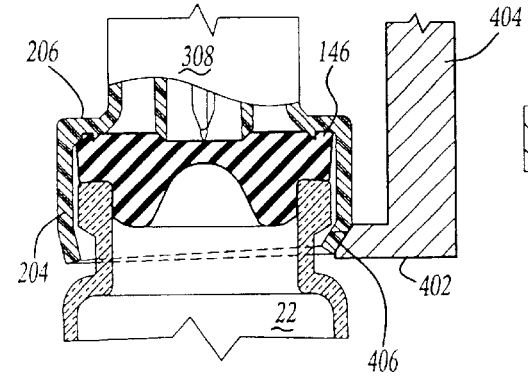
Figure 13:
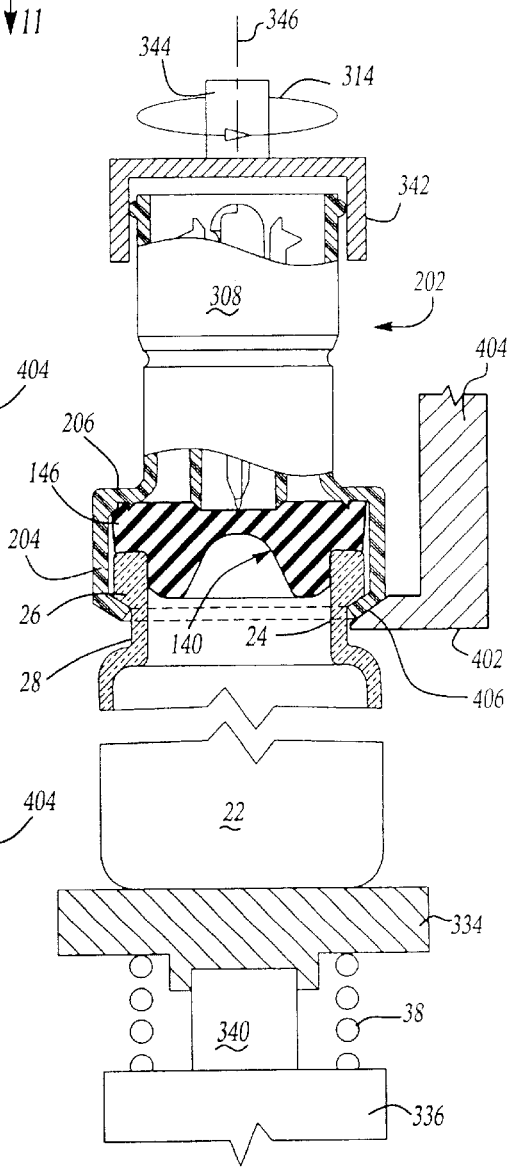

FIGS. 10 to 13 illustrate an alternative crimping apparatus 400, wherein the crimping tool includes a circular rail 402 supported on a suitable support 404. The rail 402 includes an inclined surface 406 which gradually changes in pitch from the inlet 408 to the outlet 410. That is, the tubular collar portion 204 is driven against the tapered surface 406 at the inlet 408 and the pitch of the tapered surface is continuously decreased along the rail to the outlet 410, wherein the free end portion 406 of the tubular collar portion is deformed as shown at the right in FIG. 11. The vial and transfer set assembly is continuously rotated as the tubular collar portion is driven against the rail as shown by arrows 412 and 414. FIG. 11, which is a partial cross sectional view through view arrows 11—11, illustrates the initial deformation of the tubular collar portion 204 adjacent the entrance 408, wherein the angle of inclination of the chamfered or frustoconical surface 406 is relatively steep, such as about 40 to 50 degrees or greater. FIG. 12, which is a partial cross sectional view through view arrows 12—12, illustrates the angle of inclination of the chamfered surface 406 of the rail 404 about midway through the cold deformation of the tubular collar portion, wherein the angle of inclination is less than 40 degrees. Finally, FIG. 13 illustrates the angle of inclination 406 of the chamfered surface adjacent the outlet 410, wherein the angle of inclination is less than 30 degrees, fully deforming the free end of the tubular collar portion 204 into the reduced diameter neck portion 28 of the vial and against the rim portion 26. Thus, the rim portion is gradually deformed by the continuously decreasing angle of inclination of the chamfered or frustoconical surface 406 in a gradual and continuous process. FIG. 13 also illustrates the simultaneous compression of the radial portion 206 of the collar against the planar portion 146 of the elastomeric closure and compression of the closure against the rim portion 26 of the vial during cold forming of the tubular collar portion 204 as described above in regard to FIG. 8, which is a preferred embodiment of the method of this invention.

Thus, in both of the preferred embodiments of cold forming the free end of the plastic closure into the reduced diameter neck portion of the vial or other medical container as described above and shown in FIGS. 8 and 9 and FIGS. 10 to 13, respectively, the free end is gradually or incrementally deformed radially into the neck portion to assure permanent deformation, reduce creep which could result in leakage and reduce damage to the closure, such as cracking or discoloration of a clear plastic closure. Thus, the method of this invention provides a simple and relatively inexpensive method of crimping or cold forming a plastic closure or collar which avoids the disadvantages of a malleable metal closure or collar and which assures complete sealing of the vial. The tubular collar portion of the closure or collar may also be deformed into the reduced diameter neck portion of the vial or other container by a crimping device (not shown) having a jaw which deforms the free end portion of the tubular collar portion into the neck portion one at a time provided the deformation is gradual to avoid damage to the collar portion.

The deformation of the free end of the collar portion in each of these embodiments is a cold forming process which, as set forth above, also relies upon the polymer selected for the collar or closure. That is, the polymer selected must be sufficiently malleable to permit radial deformation or crimping without forming stress cracking or fractures. Further, the polymer must be sufficiently rigid to retain its shape following deformation. Finally, the polymer must also be sufficiently resistant to creep to maintain the seal between the plastic closure or collar and the container following radial deformation to prevent leakage or contamination of the materials stored in the container. One important advantage of the method of this invention is that the crimping process may be performed in an aseptic environment preventing contamination of the material within the vial and the assembly. As set forth above, another important advantage of the method of this invention is that the improved polymeric closure eliminates the potential contamination and hazards associated with malleable metal closures, such as aluminum. As will be understood, various modifications to the disclosed methods of sealing a vial or other container with a polymeric closure of this invention within the purview of the appended claims.

What is claimed is:

1. A method of sealing a container with a plastic closure, said container having an open end, a radial rim portion surrounding said open end, a reduced diameter neck portion adjacent said rim portion and an enclosed container portion adjacent said neck portion, said method comprising:

forming a plastic closure of a polymer alloy comprising a relatively malleable soft polymer and a relatively rigid polymer, said plastic closure being sufficiently malleable to permit radial deformation, yet sufficiently rigid to retain its shape following deformation, and sufficiently resistant to creep to maintain a seal between the container and the plastic closure following radial deformation, said plastic closure including a generally cylindrical tubular collar portion having an internal diameter generally equal to or slightly greater than an outside diameter of said rim portion of said container and an integral radial rim portion;

telescopically disposing said generally cylindrical tubular collar portion of said plastic closure over said rim portion of said container with said radial rim portion of said plastic closure overlying said rim portion of said container and said generally cylindrical tubular collar portion surrounding said rim of said container having a free end surrounding said reduced diameter neck portion of said container;

radially deforming said free end of said generally cylindrical tubular collar portion of said plastic closure into said reduced diameter neck portion of said container beneath said rim portion, said free end of said plastic closure retaining its shape beneath said radial rim portion of said container following deformation to permanently retain said plastic closure on said container and sealing said container open end; and deforming said free end of said tubular portion of said plastic closure into said reduced diameter neck portion of said container using a crimping tool having an inclined surface, said method including relatively rotating said crimping tool and said container with said plastic closure assembled thereon, simultaneously driving said inclined surface against said tubular portion of said closure adjacent said free end, simultaneously cold forming said free end gradually into said reduced diameter neck portion and against said rim portion of said container, permanently deforming said free end into said reduced diameter neck portion and against said rim portion of said container.

2. The method of sealing a container with a plastic closure as defined in claim 1, wherein said container includes an elastomeric stopper in said container open end having a radial portion overlying said radial rim portion of said container, said method including compressing said integral radial rim portion of said plastic closure against said radial portion of said elastomeric stopper to seal said plastic closure to said elastomeric stopper and substantially simultaneously radially deforming said free end of said closure tubular collar portion into said reduced diameter neck portion of said container.

3. The method of sealing a container with a plastic closure as defined in claim 1, wherein said inclined surface of said crimping tool is frustoconical and said method includes rotating said container with said plastic closure assembled thereon and rotating said crimping tool.

4. The method of sealing a container with a plastic closure as defined in claim 1, wherein said method includes sequentially driving a plurality of crimping tools against said tubular portion of said plastic closure adjacent said free end, each of said crimping tools having an inclined surface of a decreasing angle of inclination, thereby gradually deforming said plastic closure into said reduced diameter neck portion without damaging said closure.

5. The method of sealing a container with a plastic closure as defined in claim 1, wherein said inclined surface of said crimping tool is stationary having a gradually decreasing angle of inclination and said method includes rotating said container with said plastic closure assembled thereon and driving said container with said plastic closure assembled thereon and driving said container and plastic closure against said gradually decreasing inclined surface.

6. The method of sealing a container with a plastic closure as defined in claim 5, wherein said gradually decreasing inclined surface is located on an inside surface of an arcuate rail and said method including simultaneously rotating said container with said plastic closure assembled thereon against said inclined tapered surface of said rail, said tubular collar portion of said closure adjacent said free end being deformed against said inclined surface, and said tubular portion rolling along said arcuate inside inclined surface of said rail, gradually cold forming the circumference of said free end portion of said tubular collar portion into said reduced diameter neck portion of said container and against said radial rim portion.

7. The method of sealing a container with a plastic closure as defined in claim 2, wherein said closure includes an integral second tubular portion extending from said radial rim portion of said closure generally coaxially aligned with said tubular collar portion, said method including assembling a piercing element in said second tubular portion releasably retained in said second tubular portion and movable relative to said tubular portion, telescopically disposing said tubular collar portion of said closure on said rim portion of said container with said piercing element telescopically coaxially aligned with said open end of said container, then radially deforming said free end of said generally cylindrical tubular collar portion of said closure into said neck portion of said container.

8. The method of sealing a container with a plastic closure as defined in claim 7, wherein said second tubular portion includes an open end, said method further including sealing said open end of said second tubular portion with a cap following radially deforming said free end of said generally cylindrical tubular collar portion of said closure into said neck portion of said container.

9. The method of sealing a container with a plastic closure as defined in claim 1, wherein said method includes injection molding said plastic closure.

10. A method of sealing a vial with a polymeric closure, said vial having an open end, a radial rim portion surrounding said open end and a reduced diameter neck portion adjacent said radial rim portion, said method comprising:

injection molding a polymeric closure from a polymer which is sufficiently malleable to permit radial deformation, yet sufficiently rigid to retain its shape following deformation and sufficiently resistant to creep to maintain a seal between the polymeric closure and the vial following radial deformation, said closure including a generally cylindrical tubular collar portion having an internal diameter slightly greater than an outside diameter of said rim portion of said vial and an integral radial rim portion;

telescopically receiving said tubular collar portion of said polymeric closure over said radial rim portion of said vial with said rim portion of said polymeric closure overlying said rim portion of said vial and said tubular collar portion surrounding said rim portion and said reduced diameter neck portion of said vial; and gradually cold forming said tubular collar portion of said polymeric closure with a crimping tool having an inclined surface facing said tubular collar portion opposite said neck portion of said vial and relatively rotating said vial and said crimping tool, said inclined surface of said crimping tool gradually cold forming said tubular collar portion of said polymeric closure radially inwardly into said reduced diameter neck portion and against an adjacent surface of said rim portion of said vial, permanently securing said closure on said vial and sealing said open end.

11. The method of sealing a vial with a polymeric closure as defined in claim 10, wherein said inclined surface of said tool is frustoconical and said method includes relatively rotating said crimping tool and said vial and relatively driving said frustoconical surface against said tubular collar portion of said polymeric closure adjacent a free end of said tubular collar portion.

12. The method of sealing a vial with a polymeric closure as defined in claim 11, wherein said method includes rotating said vial with said polymeric closure assembled thereon relative to said crimping tool and driving said tubular collar portion of said polymeric closure against said inclined surface of said crimping tool.

13. The method of sealing a vial with a polymeric closure as defined in claim 11, wherein said method includes sequentially driving a plurality of crimping tools against said tubular collar portion, said crimping tools each having an inclined surface of a decreasing angle of inclination, thereby gradually cold forming said tubular collar portion of said polymeric closure radially inwardly into said reduced diameter neck portion without damaging said polymeric closure.

14. The method of sealing a vial with a polymeric closure as defined in claim 11, wherein said inclined surface of said crimping tool is located on an inside surface of an arcuate stationary rail and said method includes driving said tubular collar portion of said polymeric closure against said inclined surface and simultaneously rotating said vial and said tubular collar portion rolling along said arcuate inside tapered surface of said crimping tool deforming the entire circumference of said tubular portion against said rim portion of said vial.

15. The method of sealing a vial with a polymeric closure as defined in claim 14, wherein said inclined surface of said crimping tool has a gradually decreasing angle of inclination, wherein said method includes driving said tubular collar portion of said polymeric closure against said inclined surface having a gradually decreasing angle of inclination, thereby gradually cold forming said tubular collar portion of said polymeric closure radially inwardly into said reduced diameter neck portion.

16. The method of sealing a vial with a plastic closure as defined in claim 1, wherein said vial includes an elastomeric stopper in said vial open end having a radial portion overlying said rim portion of said vial, said method including compressing said integral radial rim portion of said polymeric closure against said radial portion of said stopper to seal said polymeric closure to said stopper and substantially simultaneously radially deforming said tubular collar portion of said closure into said reduced diameter neck portion of said vial.

17. The method of sealing a vial with a polymeric closure as defined in claim 16, wherein said polymeric closure includes an integral second tubular portion extending from said radial rim portion spaced from generally coaxially aligned with said tubular portion, said method including assembling a piercing member in said second tubular portion releasably retained in said second tubular portion, telescopically disposing said tubular collar portion of said closure on said rim portion of said vial with said piercing member coaxially aligned with said open end of said vial and movable relative to said elastomeric stopper to pierce said stopper, then radially deforming said tubular collar portion of said elastomeric closure into said neck portion of said vial.

18. The method of sealing a vial with a polymeric closure as defined in claim 10, wherein said method includes injection molding said polymeric closure from a polymer alloy comprising a relatively malleable soft polymer and a relatively rigid polymer.

19. The method of sealing a vial with a polymeric closure as defined in claim 18, wherein said method includes co-injecting a polymer alloy including a polycarbonate and a soft malleable co-polymer.

20. A method of sealing a container with a polymeric closure, said container having an open end, a radial rim portion surrounding said open end and a reduced diameter neck portion adjacent said rim portion and an elastomeric septum received in said open end of said container having a rim portion overlying said rim portion of said container, said method comprising the following steps:

forming a polymeric closure including a generally cylindrical tubular portion having an internal diameter slightly greater than an outside diameter of said rim portion of said container and an integral radial rim portion from a polymer which is sufficiently malleable to permit radial deformation, yet sufficiently rigid to retain its shape following deformation and sufficiently resistant to creep to maintain a seal between said polymeric closure and said container following radial deformation;

telescopically receiving said tubular collar portion of said polymeric closure over said radial rim portion of said container and said rim portion of said elastomeric septum with said rim portion of said polymeric closure overlying said rim portion of said elastomeric stopper and said tubular collar portion surrounding said rim portion and said reduced diameter neck portion of said container; and simultaneously compressing said rim portion of said polymeric closure against said rim portion of said elastomeric septum and gradually cold forming said tubular collar portion of said polymeric closure against an inclined surface of a crimping tool having a decreasing angle of inclination opposite said neck portion of said container and relatively rotating said vial against said inclined surface of said crimping tool, gradually cold forming said tubular collar portion of said polymeric closure radially inwardly into said reduced diameter neck portion of said container, permanently securing said closure on said container and sealing said open end of said container.

21. The method of sealing a container with a polymeric closure as defined in claim 20, wherein said method includes sequentially driving a plurality of crimping tools against said tubular collar portion of said polymeric closure each having an inclined surface of a different decreased angle of inclination, thereby gradually cold forming said tubular collar portion of said polymeric closure into said reduced diameter neck portion of said container.

22. The method of sealing a container with a polymeric closure as defined in claim 20, wherein said method includes gradually cold forming said tubular collar portion of said polymeric closure by driving said container and polymeric closure against a stationary crimping tool having a gradually decreasing angle of inclination and simultaneously rotating said container and polymeric closure while maintaining compression of said radial rim portion of said polymeric closure against said rim portion of said elastomeric septum.

23. A method of sealing a container with a plastic closure, said container having an open end, a radial rim portion surrounding said open end, a reduced diameter neck portion adjacent said rim portion and an enclosed container portion adjacent said neck portion, said method comprising:

forming a plastic closure of a polymer which is sufficiently malleable to permit radial deformation, yet sufficiently rigid to retain its shape following deformation, and sufficiently resistant to creep to maintain a seal between the container and the plastic closure following radial deformation, said plastic closure including a generally cylindrical tubular collar portion having an internal diameter generally equal to or slightly greater than an outside diameter of said rim portion of said container and an integral radial rim portion;

telescopically disposing said generally cylindrical tubular collar portion of said plastic closure over said rim portion of said container with said radial rim portion of said plastic closure overlying said rim portion of said container and said generally cylindrical tubular collar portion surrounding said rim of said container having a free end surrounding said reduced diameter neck portion of said container; and, radially deforming said free end of said generally cylindrical tubular collar portion of said plastic closure into said reduced diameter neck portion of said container beneath said rim portion, said free end of said plastic closure retaining its shape beneath said radial rim portion of said container following deformation to permanently retain said plastic closure on said container and sealing said container open end, wherein said deforming said free end of said tubular portion of said plastic closure into said reduced diameter neck portion of said container includes using a crimping tool having an inclined surface, relatively rotating said crimping tool and said container with said plastic closure assembled thereon, simultaneously driving said inclined surface against said tubular portion of said closure adjacent said free end, simultaneously cold forming said free end gradually into said reduced diameter neck portion and against said rim portion of said container, permanently deforming said free end into said reduced diameter neck portion and against said rim portion of said container.

24. The method of sealing a container with a plastic closure as defined in claim 23, wherein said inclined surface of said crimping tool is frustoconical and said method includes rotating said container with said plastic closure assembled thereon and rotating said crimping tool.

25. The method of sealing a container with a plastic closure as defined in claim 23, wherein said method includes sequentially driving a plurality of crimping tools against said tubular portion of said plastic closure adjacent said free end, each of said crimping tools having an inclined surface of a decreasing angle of inclination, thereby gradually deforming said plastic closure into said reduced diameter neck portion without damaging said closure.

26. The method of sealing a container with a plastic closure as defined in claim 23, wherein said inclined surface of said crimping tool is stationary having a gradually decreasing angle of inclination and said method includes rotating said container with said plastic closure assembled thereon and driving said container with said plastic closure assembled thereon and driving said container and plastic closure against said gradually decreasing inclined surface.

27. The method of sealing a container with a plastic closure as defined in claim 26, wherein said gradually decreasing inclined surface is located on an inside surface of an arcuate rail and said method including simultaneously rotating said container with said plastic closure assembled thereon against said inclined tapered surface of said rail, said tubular collar portion of said closure adjacent said free end being deformed against said inclined surface, and said tubular portion rolling along said arcuate inside inclined surface of said rail, gradually cold forming the circumference of said free end portion of said tubular collar portion into said reduced diameter neck portion of said container and against said radial rim portion.

28. A method of sealing a container with a plastic closure, said container having an open end, a radial rim portion surrounding said open end, a reduced diameter neck portion adjacent said rim portion and an enclosed container portion adjacent said neck portion, said method comprising:

forming a plastic closure of a polymer which is sufficiently malleable to permit radial deformation, yet sufficiently rigid to retain its shape following deformation, and sufficiently resistant to creep to maintain a seal between the container and the plastic closure following radial deformation, said plastic closure including a generally cylindrical tubular collar portion having an internal diameter generally equal to or slightly greater than an outside diameter of said rim portion of said container and an integral radial rim portion, an integral second tubular portion extending from said radial rim portion of said closure generally coaxially aligned with said tubular collar portion, and an elastomeric stopper in said container open end having a radial portion overlying said radial rim portion of said container;

assembling a piercing element in said second tubular portion releasably retained in said second tubular portion and movable relative to said tubular portion;

telescopically disposing said generally cylindrical tubular collar portion of said plastic closure over said rim portion of said container with said radial rim portion of said plastic closure overlying said rim portion of said container, said generally cylindrical tubular collar portion surrounding said rim of said container having a free end surrounding said reduced diameter neck portion of said container, and said piercing element telescopically coaxially aligned with said open end of said container;

compressing said integral radial rim portion of said plastic closure against said radial portion of said elastomeric stopper to seal said plastic closure to said elastomeric stopper; and, radially deforming said free end of said generally cylindrical tubular collar portion of said plastic closure into said reduced diameter neck portion of said container beneath said rim portion, said free end of said plastic closure retaining its shape beneath said radial rim portion of said container following deformation to permanently retain said plastic closure on said container and sealing said container open end, said compressing and said deforming being substantially simultaneous.

29. The method of sealing a container with a plastic closure as defined in claim 28, wherein said second tubular portion includes an open end, said method further including sealing said open end of said second tubular portion with a cap following radially deforming said free end of said generally cylindrical tubular collar portion of said closure into said neck portion of said container.

* * * * *